US010786985B2

(12) United States Patent
Nakazawa et al.

(10) Patent No.: US 10,786,985 B2
(45) Date of Patent: Sep. 29, 2020

(54) PRINTING METHOD AND PRINTING APPARATUS FOR COMPENSATING FOR DOT OMISSION

(71) Applicant: SEIKO EPSON CORPORATION, Tokyo (JP)

(72) Inventors: Yuki Nakazawa, Suwa-gun (JP); Naoki Maruyama, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/294,527

(22) Filed: Mar. 6, 2019

(65) Prior Publication Data

US 2019/0275790 A1 Sep. 12, 2019

(30) Foreign Application Priority Data

Mar. 7, 2018 (JP) ..... 2018-040379

(51) Int. Cl.
*B41J 2/045* (2006.01)
*B41J 2/21* (2006.01)

(52) U.S. Cl.
CPC ..... *B41J 2/0451* (2013.01); *B41J 2/04586* (2013.01); *B41J 2/21* (2013.01)

(58) Field of Classification Search
CPC ..... B41J 2/0451; B41J 2/21; B41J 2/04586; B41J 2/2117; B41J 2/2114; B41J 2/2139; B41J 2/2146; B41J 11/002; B41J 2025/008; B41J 3/00
See application file for complete search history.

(56) References Cited

U.S. PATENT DOCUMENTS

2006/0056699 A1* 3/2006 Kusakari ..... B41J 2/2142 382/190
2006/0268034 A1* 11/2006 Lee ..... B41J 29/393 347/12
2013/0120490 A1* 5/2013 Nakajima ..... B41J 11/002 347/19
2016/0115331 A1* 4/2016 Yazaki ..... B41M 5/0023 347/100

FOREIGN PATENT DOCUMENTS

JP 2016-147421 A 8/2016

* cited by examiner

*Primary Examiner* — Sharon A. Polk
(74) *Attorney, Agent, or Firm* — Foley & Lardner LLP

(57) ABSTRACT

Provided is a printing method for forming ink dots on a printing medium by using a plurality of nozzle rows that discharge a plurality of types of photocurable inks. The printing method includes detecting a defective nozzle that has an ink discharge fault, and compensating for dot omission by causing, preceding the defective nozzle, a preceding nozzle that discharges an inducing ink different from a compensation target ink, which the defective nozzle should have discharged, to discharge the inducing ink to a position on the printing medium where dot omission occur due to the defective nozzle.

9 Claims, 7 Drawing Sheets

PRINTING METHOD AND PRINTING APPARATUS FOR COMPENSATING FOR DOT OMISSION

BACKGROUND

1. Technical Field

The disclosure relates to a printing method and a printing apparatus for compensating for dot omission due to a defective nozzle.

2. Related Art

JP-A-2016-147421 discloses an art for compensating for dot omission in an ink-jet printer. In this related art, a nozzle of a following head set at the same position as a defective nozzle of a preceding head is used to discharge ink of the same hue as the defective nozzle to induce a dot discharged from a nozzle adjacent to the defective nozzle to be spread out, thus compensating for dot omission.

However, the inventors of this application discovered that dot omission occurring in print operation in which photocurable ink is used have not yet sufficiently been compensated for with the above-described related art.

SUMMARY

According to an aspect of the present invention, a printing method for forming ink dots on a printing medium using a plurality of nozzle rows that discharge a plurality of types of photocurable inks is provided. The printing method includes detecting a defective nozzle that has an ink discharge fault, and compensating for dot omission by causing, preceding the defective nozzle, a preceding nozzle that discharges an inducing ink different from a compensation target ink, which the defective nozzle should have discharged, to discharge the inducing ink to a position on the printing medium where the dot omission is caused by the defective nozzle.

According to another aspect of the present invention, a printing apparatus configured to form ink dots on a printing medium is provided. The printing apparatus includes a printing head including a plurality of nozzle rows that discharge a plurality of types of photocurable inks, a light irradiator configured to irradiate photocuring light on the printing medium, the ink being discharged from each of the plurality of nozzle rows, a controller configured to execute discharge control to cause the plurality of nozzle rows to discharge inks, and a defective nozzle detector configured to detect a defective nozzle that has an ink discharge fault. The controller is configured to compensate for dot omission by causing, preceding the defective nozzle, a preceding nozzle that discharges an inducing ink different from a compensation target ink, which the defective nozzle should have discharged, to discharge the inducing ink to a position on the printing medium where the dot omission is caused by the defective nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Exemplary Embodiment

Figure 1:
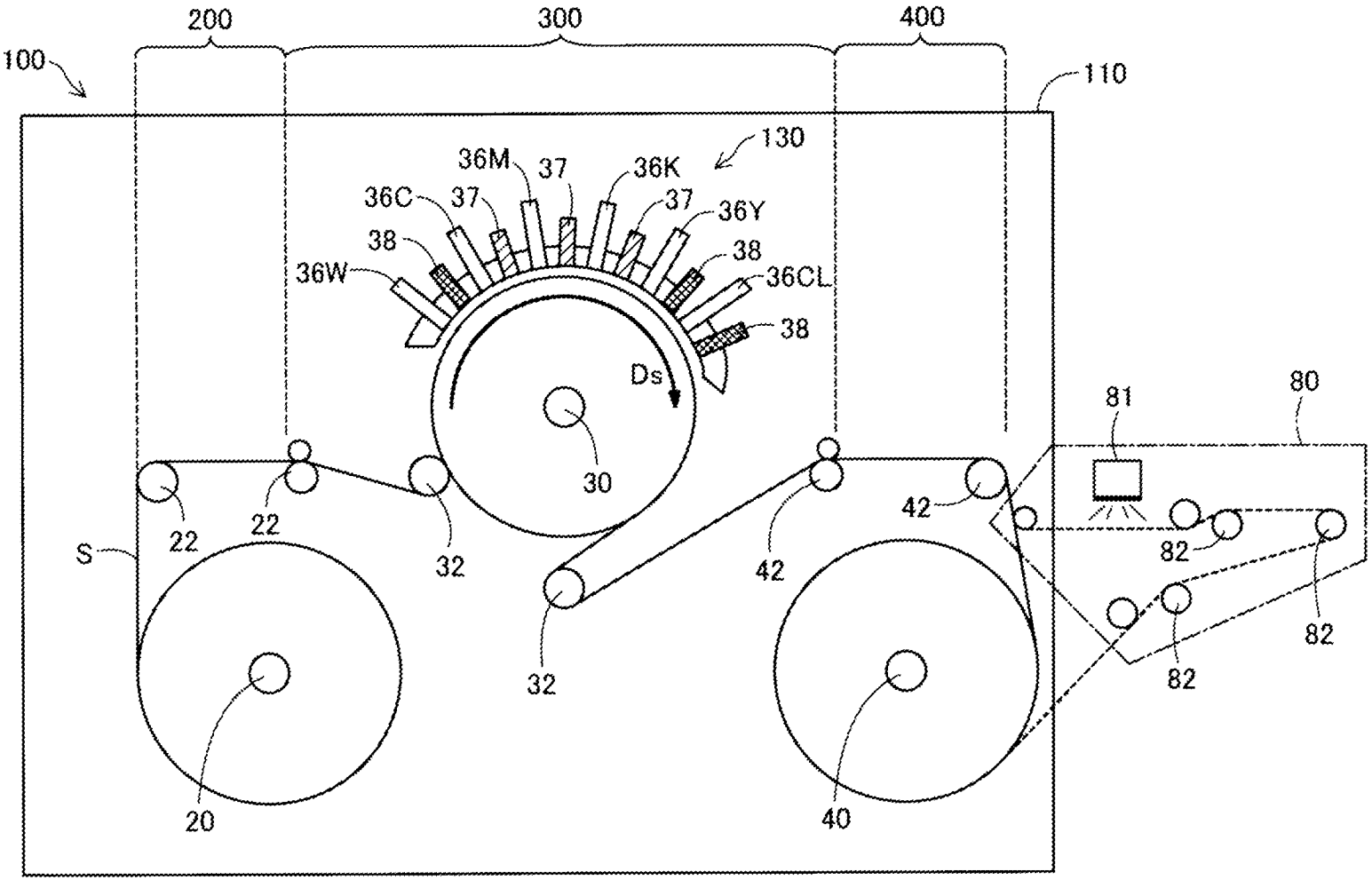
FIG. 1 is a schematic view illustrating a configuration of a printing apparatus according to an exemplary embodiment.

FIG. 1 is a schematic view illustrating a schematic configuration of a printing apparatus 100 as an exemplary embodiment. The printing apparatus 100 serves as an inkjet printer, in which a feeding section 200, a process section 300, and a winding section 400 arranged in this order are housed in an interior space of a housing 110. The feeding section 200 and the winding section 400 each include a feeding shaft 20 and a winding shaft 40, respectively. A printing medium S fed from the feeding shaft 20 is transferred by rollers 22 to the process section 300, in which the printing medium S is subjected to a printing process. Then, the printing medium S is transferred by rollers 42 to the winding shaft 40.

As the printing medium S, paper-type printing medium and film-type printing medium can be used. Examples of the paper-type printing medium include high-quality paper, cast coated paper, art paper, coat paper, and the like. while examples of the film-type printing medium include synthetic paper and film formed of polyethylene terephthalate (PET) or polypropylene (PP), and the like.

The process section 300, while supporting the printing medium S fed from the feeding section 200 by a rotary drum 30, performs printing an image on the printing medium S by a printing head 130, which discharges a plurality of inks, arranged along an outer circumferential surface of the rotary drum 30. The process section 300 is provided with a plurality of rollers 32. The printing medium S being supported by the rollers 32 and the rotary drum 30 is transferred along a transfer direction Ds. The transfer direction Ds of the printing medium S is also referred to as "paper feed direction Ds".

The printing head 130 includes a plurality of nozzle rows 36W, 36C, 36M, 36K, 36Y, and 36CL. These nozzle rows 36W, 36C, 36M, 36K, 36Y, and 36CL discharge white ink W, cyan ink C, magenta ink M, black ink K, yellow ink Y, and clear ink CL, respectively. The clear ink CL, which is almost colorless and transparent, is used to impart gloss to printed materials. Note that these nozzle rows, when there is no need to be handled individually, are each referred to as "nozzle array 36". A plurality of nozzle rows 36, arranged in the above-described order along the outer circumferential surface of the rotary drum 30, oppose a surface of the printing medium S with a predefined gap in between. The ink discharged from each of the plurality of nozzle rows 36 adheres to the printing medium S to form ink dots, thus causing a color image to be printed.

As an ink used in the nozzle rows 36, a photocurable ink, which is curable when irradiated with light, is used. In First Exemplary Embodiment, a UV ink, which is curable with ultraviolet light, is used. The printing head 130 includes first light irradiators 37 and second light irradiators 38 for curing the ink discharged onto the printing medium S. The second light irradiators 38 irradiate stronger light than the first light irradiators 37. The "strong light" represents light with a large amount of light.

Figure 2:
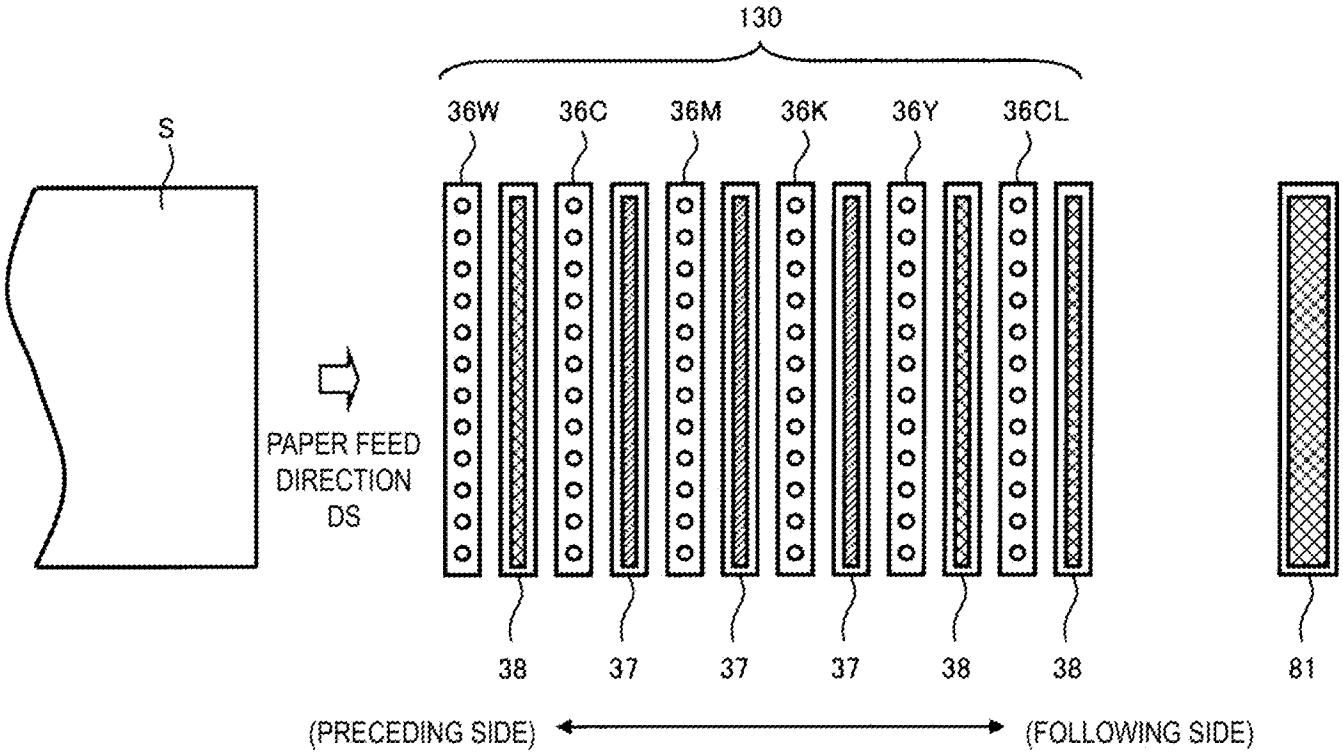
FIG. 2 is an explanatory view illustrating an arrangement of nozzle rows and light irradiators of a printing head.

FIG. 2 is an explanatory view illustrating an arrangement of the nozzle rows 36 and the light irradiators 37 and 38 in the printing head 130. Here, for convenience of illustration, the nozzles of each nozzle array 36 are illustrated in a number less than the actual number. As the printing head 130, for example, an ink-jet printing head of a type in which a diaphragm is deflected, with deformation of a drive element such as a piezoelectric element, to cause ink stored in an ink chamber to be discharged from nozzle holes.

When viewed along the paper feed direction Ds, the first light irradiator 37 delivering a small amount of light is disposed at a position immediately after the nozzle rows 36C, 36M, and 36K that discharge cyan ink C, magenta ink M, and black ink K. On the other hand, the second light irradiator 38 delivering a large amount of light is disposed at a position immediately after the nozzle rows 36W, 36Y, and 36CL that discharge white ink W, yellow ink Y, and clear ink CL, respectively. As a rule, a greater amount of irradiated light causes the photocurable ink to be cured faster. Since there are a large number of applications in which the white ink W and the clear ink CL are often superimposed when printed, the second light irradiator 38 is disposed immediately after the nozzle rows 36W and 36CL in order to ensure curing in each process, to thus prevent insufficient curing of the ink in the bottom layer. Further, the second light irradiator 38 with a large amount of light is disposed immediately after the nozzle array 36Y in order to cause all the inks to be cured at the stage when cyan ink C, magenta ink M, black ink K, and yellow ink Y are to be aligned on the printing medium S. In contrast, the first light irradiator 37 with a small amount of light is disposed immediately after the nozzle rows 36C, 36M, and 36K in order to perform temporary curing that is enough for preventing inks from bleeding into each other. This is because the second light irradiator 38 with a large amount of light disposed immediately after the nozzle array 36Y is disposed to a downstream side of the nozzle rows 36C, 36M, and 36K when viewed along the paper feed direction Ds. However, any of the two types of light irradiators 37 and 38 is disposed immediately after each nozzle array 36 may be freely determined depending on the characteristics of the ink. Alternatively, instead of using these two types of light irradiators 37 and 38, an identical type of light irradiator may be disposed at a position immediately after each nozzle array 36. Furthermore, light irradiators provided immediately after some of the nozzle rows 36 may be omitted. However, it is preferable that a light irradiator is provided immediately after each nozzle array 36 in order to cure each ink relatively faster to stabilize the dots.

A third light irradiator 81 is additionally disposed at a subsequent stage to the second light irradiator 38 disposed immediately after the nozzle array 36CL that discharges the clear ink CL. As illustrated in FIG. 1, the third light irradiator 81 is provided in a light irradiation unit 80, which is installable as an external optional unit. The light irradiation unit 80 includes the third light irradiator 81, and a plurality of rollers 82 for transferring the printing medium S. The third light irradiator 81 additionally performs light irradiation on the printed material on which printing has been performed by the printing head 130, to thus further ensure curing of the ink. However, the third light irradiator 81 may be omitted.

Figure 3:
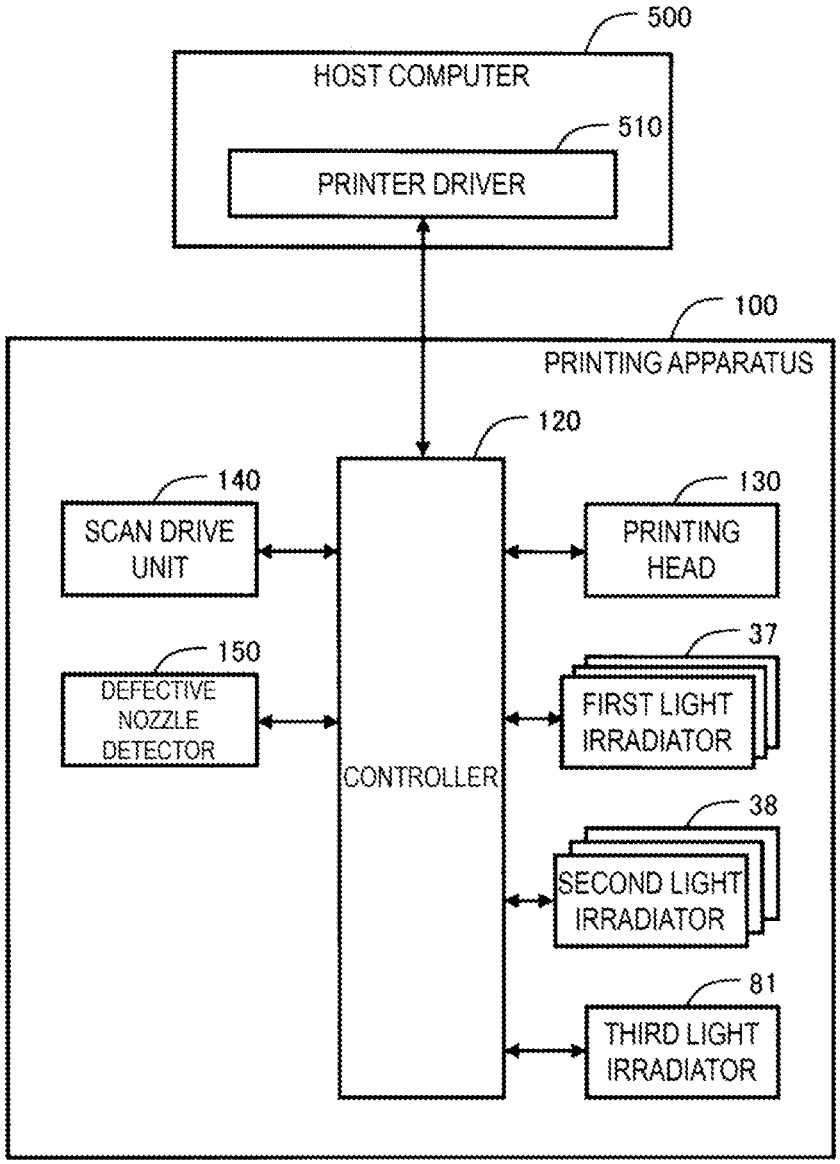
FIG. 3 is a block diagram illustrating a function of a printing apparatus.

FIG. 3 is a block diagram illustrating a function of the printing apparatus 100. The printing apparatus 100 performs printing in accordance with print data supplied from a printer driver 510 of a host computer 500. The printing apparatus 100 and the host computer 500 constitute a printing system. The printing apparatus 100 includes a controller 120, a scan drive unit 140, and a defective nozzle detector 150, in addition to the printing head 130 and the light irradiators 37, 38, and 81. The scan drive unit 140 serves as a drive mechanism configured to drive the rotary drum 30 and the rollers illustrated in FIG. 1 to transfer the printing medium S along the paper feed direction Ds.

The defective nozzle detector 150 detects whether each of the nozzles of the printing head 130 has a discharge fault. For example, the defective nozzle detector 150 measures a frequency of a residual vibration of the diaphragm that bends in accordance with a drive signal to the printing head 130, to thus allow detection of whether a discharge fault occurred in each nozzle. Alternatively, the defective nozzle detector 150 may optically detect the ink discharged from each nozzle to thus detect whether a discharge fault occurred in each nozzle.

The controller 120 is configured to control each component of the printing apparatus 100. In First Exemplary Embodiment, the controller 120 is configured to perform a process of compensating for dot omission when a defective nozzle causes dot omission to occur on the printing medium S. This process is referred to as "dot omission compensation process".

Figure 4:
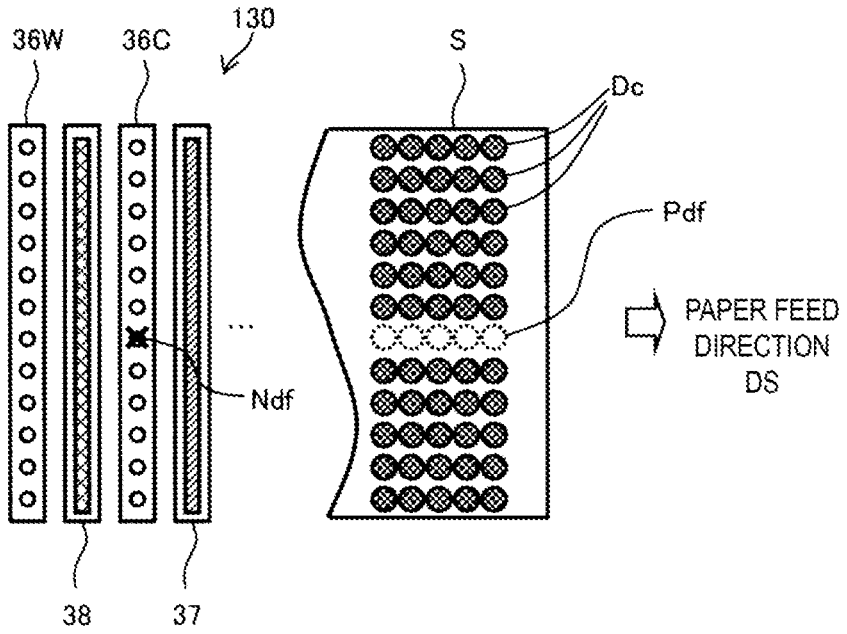
FIG. 4 is an explanatory view illustrating a state in which a defective nozzle causes dot omission to occur.

FIG. 4 is an explanatory view illustrating a state in which a defective nozzle Ndf causes dot omission to occur. Here, in the printing head 130, two nozzle rows 36W and 36C located at the most upstream side in the paper feed direction Ds and light irradiators 38 and 37 provided immediately after the two nozzle rows 36W and 36C, respectively, are exclusively illustrated. In the example of FIG. 4, the defective nozzle Ndf is assumed to exist in the nozzle array 36C for cyan ink C. At this point, a dot omission portion Pdf being a portion where the cyan dot Dc is not formed occurs on the printing medium S. In this specification, the ink that the defective nozzle Ndf should have discharged is referred to as "compensation target ink" or simply as "target ink". In the example of FIG. 4, the cyan ink C is the "compensation target ink". The ink used to compensate for the dot omission portion Pdf is referred to as "inducing ink". In the example of FIG. 4, the white ink W is used as the inducing ink.

Figure 5:
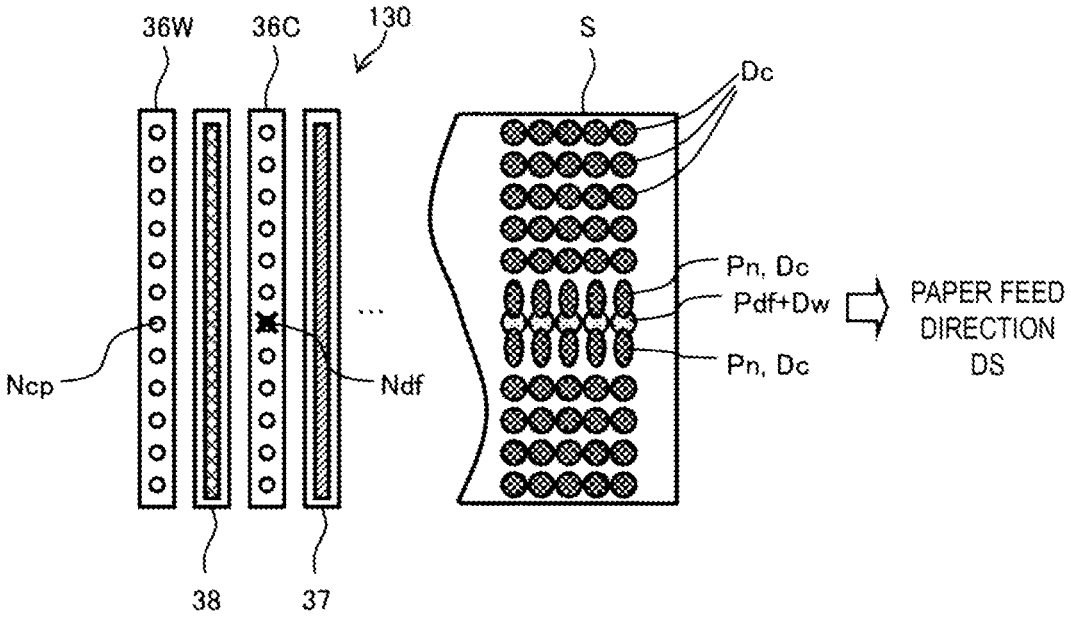
FIG. 5 is an explanatory view of a dot omission compensation process.

FIG. 5 is an explanatory view illustrating the content of the dot omission compensation process. In the dot omission compensation process, a nozzle Ncp of the nozzle array 36W, which precedes the nozzle array 36C including the defective nozzle Ndf, is caused to discharge an inducing ink W different from a compensation target ink C to a position of the dot omission portion Pdf caused by the defective nozzle Ndf, to thus compensate for the dot omission portion Pdf. The nozzle Ncp that discharges the inducing ink W to the position of the dot omission portion Pdf is referred to as "compensating nozzle Ncp" or "induction nozzle Ncp". On the printing medium S, the white ink W as the inducing ink is precedingly discharged to the position of the dot omission portion Pdf that misses cyan dots Dc to form white dots Dw. Consequently, the white ink W discharged to the position of the dot omission portion Pdf induces cyan ink C discharged to neighboring pixels Pn adjacent to the dot omission portion Pdf to be spread out toward the position of the dot omission portion Pdf. In this way, a compensating nozzle Ncp that precedes the defective nozzle Ndf is caused to discharge the inducing ink W to the position of the dot omission portion Pdf, thus, the compensation target ink C is induced to the vicinity of the dot omission portion Pdf, thus enabling the dot omission portion Pdf to be less visible.

As recognizable from the above-described arrangement of the nozzle rows 36 in FIG. 2, the nozzle array 36W of white ink W precedes all the other nozzle rows in the paper feed direction Ds. Thus, the dot omission compensation process can be performed using the nozzle array 36W of white ink W when other nozzle rows include the defective nozzle Ndf. The white ink W, which can compensate for dot omission without substantially changing the hue of the printed material, is favorably used as inducing ink for compensating for the dot omission portion Pdf. In the latter sense, the clear ink CL may be used, instead of the white ink W, to cause the dot omission portion Pdf to be compensated. In this case, the nozzle row 36CL for clear ink CL may be arranged at a position that precedes the other nozzle rows.

There may also be a case where ink other than white ink W or clear ink CL is used as the inducing ink for compensating for the dot omission portion Pdf. For example, when the compensation target ink includes chromatic color ink C, M, and Y or black ink K and the amount of the compensation target ink to be discharged to the neighboring pixels Pn of the dot omission portion Pdf is not less than a predefined threshold value, a chromatic color ink having a different hue from the compensation target ink may be caused to be selectable as the inducing ink. Specifically, when the compensation target ink is magenta ink M and the amount of the magenta ink M to be discharged to the neighboring pixels Pn of the dot omission portion Pdf is sufficiently large, cyan ink C may be used as the inducing ink. In this case, the hue of the printed material does not change too much even if a chromatic color ink with a hue different from the compensation target ink is selected, thus providing an advantage in that dot omission can be more flexibly compensated without significantly changing the hue of the printed material.

Note that, as the neighboring pixel Pn, a pixel that exists at a position satisfying a predefined neighboring condition with respect to a position where the dot omission portion Pdf will occur is selectable. Although in the example of FIG. 5, two pixels, which are adjacent to the position of the dot omission portion Pdf in a direction perpendicular to the paper feed direction Ds, are selected as the neighboring pixel Pn, "neighboring pixel" may be defined such that other pixels are also included as the neighboring pixel. For example, two pixels adjacent to the position of the dot omission portion Pdf in a direction perpendicular to the paper feed direction Ds and four pixels diagonally adjacent to the position of the dot omission portion Pdf are annexed to make six pixels in total, where each of the six pixels may be defined as a "neighboring pixel". The way the neighboring pixel is defined as above is also applicable to other exemplary embodiments to be described below.

When an ink other than the white ink W or the clear ink CL is used as inducing ink, the ink with the largest remaining amount of ink in the printing apparatus 100 may be selected as the inducing ink, among the chromatic color inks to be discharged before the defective nozzle Ndf discharges. According to this, dot omission to be compensated using a chromatic color ink with a large remaining amount of ink, thus providing an advantage in that dot omission can be compensated while enhancing ink utilization efficiency.

Figure 6:
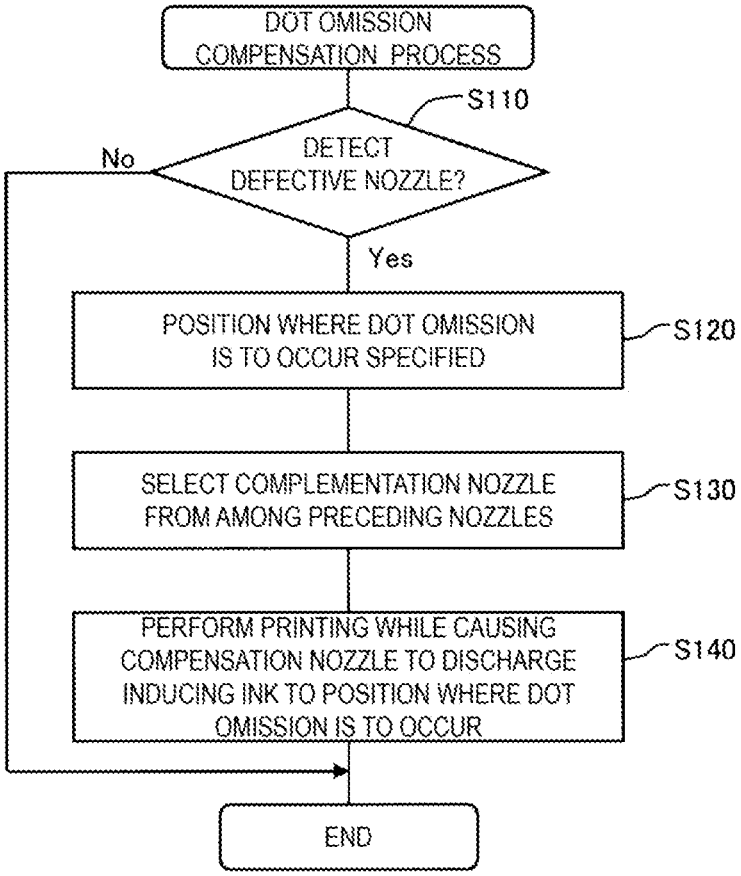
FIG. 6 is a flowchart of a dot omission compensation process.

FIG. 6 is a flowchart of the dot omission compensation process. In Step S110, the defective nozzle detector 150 detects the presence or absence of the defective nozzle Ndf. Note that, when no defective nozzle exists, the process illustrated in FIG. 6 terminates and normal printing is performed. When the defective nozzle Ndf exists, the process proceeds to Step S120, where the controller 120 specifies the position of the dot omission portion Pdf based on the position of the defective nozzle Ndf and the print data supplied from the printer driver 510. The position of the dot omission portion Pdf corresponds to the position on the printing medium S to which an ink is to be discharged from the defective nozzle Ndf according to the print data. In Step S130, the controller 120 selects the compensating nozzle Ncp to be used for the dot omission compensation process from among preceding nozzles that precede the defective nozzle Ndf (FIG. 5). In Step S140, the dot omission portion Pdf is compensated by discharging the inducing ink W from the compensating nozzle Ncp to the position of the dot omission portion Pdf. A printing in accordance with the print data is performed at positions excluding the position of the dot omission portion Pdf.

As described above, in First Exemplary Embodiment, the inducing ink W is discharged to a position where the dot omission portion Pdf is to occur using the preceding nozzle Ncp that precedes the defective nozzle Ndf, even if the dot omission portion Pdf occurs during printing is being performed using the photocurable ink, the ink of the dot Dc around the dot omission portion Pdf can be induced by the dot Dw formed by using the preceding nozzle Ncp, thus compensating for the dot omission portion Pdf.

B. Other Exemplary Embodiments

Figure 7:
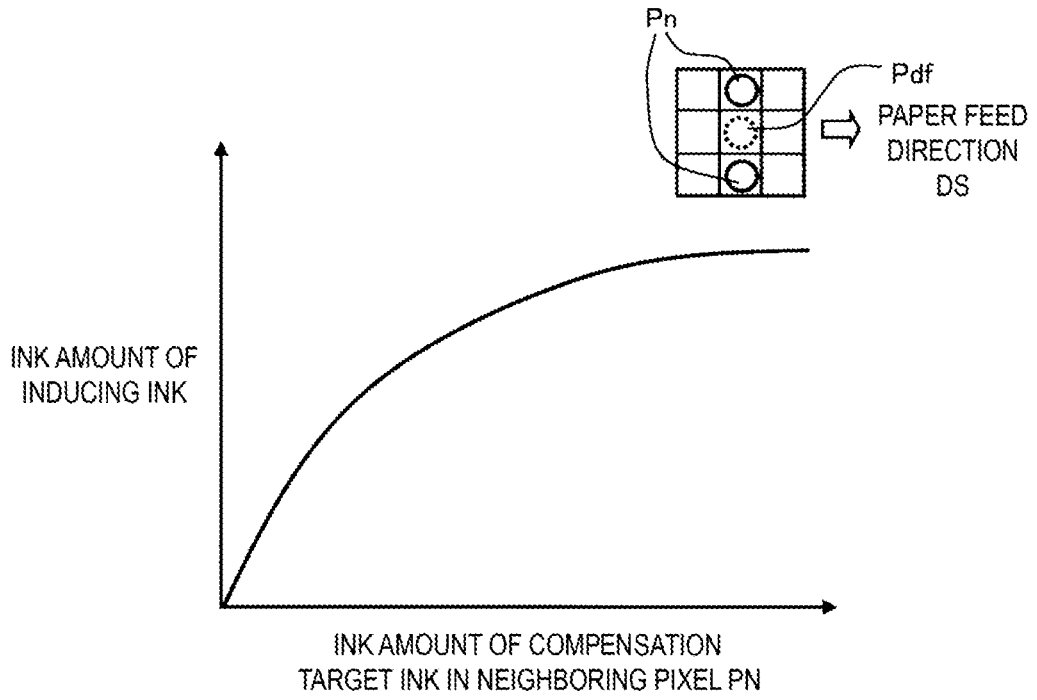
FIG. 7 is a graph illustrating a relationship between an amount of ink of a neighboring pixel of a dot omission portion and an amount of inducing ink.

FIG. 7 is a graph illustrating characteristics when an amount of inducing ink is changed in accordance with the amount of ink of the neighboring pixels Pn of the dot omission portion Pdf in another exemplary embodiment. The horizontal axis in FIG. 7 indicates the total value of the amount of inks of the compensation target ink in the neighboring pixels Pn of the dot omission portion Pdf, and the vertical axis indicates the discharge amount of the inducing ink for compensating for dot omission at the position of the dot omission portion Pdf. In this example, the amount of the inducing ink to be discharged to the position of the dot omission portion Pdf is increased as the amount of the target ink to be discharged to the neighboring pixels Pn is larger. When the amount of the compensation target ink neighboring a position where the dot omission portion Pdf is to occur is large, the hue in a region of the neighboring pixels Pn does not change too much even if the ink is induced to the inducing ink. This provides an advantage in that the dot omission can be compensated more sufficiently without significantly changing the hue of the printed material.

Figure 8:
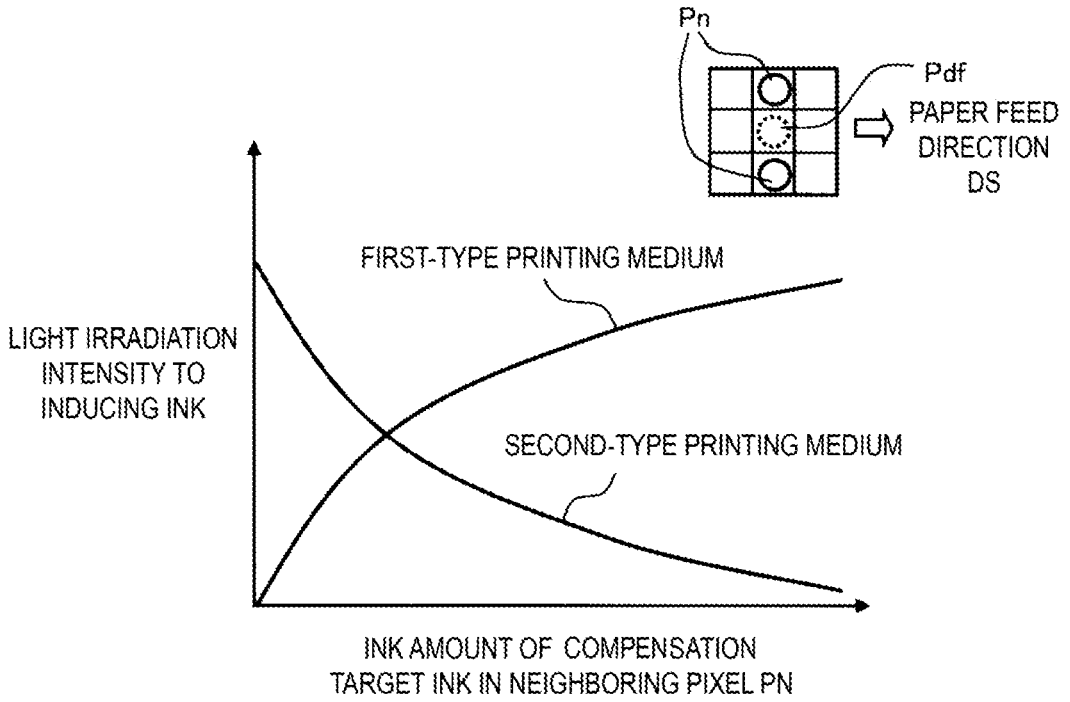
FIG. 8 is a graph illustrating relationship between an amount of ink of a neighboring pixel of a dot omission portion and light irradiation intensity to inducing ink.

FIG. 8 is a graph illustrating characteristics when light irradiation intensity to inducing ink is adjusted in accordance with the amount of ink of the neighboring pixels Pn of the dot omission portion Pdf in still another exemplary embodiment. The horizontal axis in FIG. 8 indicates the total value of the amounts of the compensation target ink in the neighboring pixel Pn of the dot omission portion Pdf, and the vertical axis indicates the light irradiation intensity for irradiating the inducing ink for compensating for the dot omission. The light irradiation intensity represents an intensity of light irradiated from a light irradiator disposed immediately after a nozzle row that discharges the inducing ink. In this example, in a first-type printing medium, the light irradiation intensity to the inducing ink is set to be higher as the amount of the compensation target ink to be discharged to the neighboring pixels Pn is larger. On the other hand, in a second-type printing medium, the light irradiation intensity to the inducing ink is set to be lower as the amount of the compensation target ink to be discharged to the neighboring pixels Pn is larger. As recognizable from this example, the compensation effect due to the inducing ink may be adjusted by adjusting an intensity of light irradiated on the inducing ink existing on the printing medium, which is after the inducing ink for compensating for dot omission being discharged and before the compensation target ink being discharged using the nozzle row including the defective nozzle Ndf. According to this, the compensation effect due to the inducing ink is adjusted by adjusting the light intensity, thus a desirable compensation effect can be obtained.

Note that, as illustrated in FIG. 8, the adjustment direction of light irradiation intensity may be set to be an opposite direction depending on the types of printing medium. It is experimentally determined whether each printing medium belongs to first-type printing medium in which the characteristics illustrated in FIG. 8 are convex upward or second-type printing medium in which the characteristics illustrated in FIG. 8 are convex downward. In this way, the adjustment direction of the intensity of light irradiated on the inducing ink is set reversed in accordance with the type of the printing medium, thus providing an advantage in that a suitable effect of compensating for dot omission in accordance with the type of printing medium can be obtained.

Figure 9:
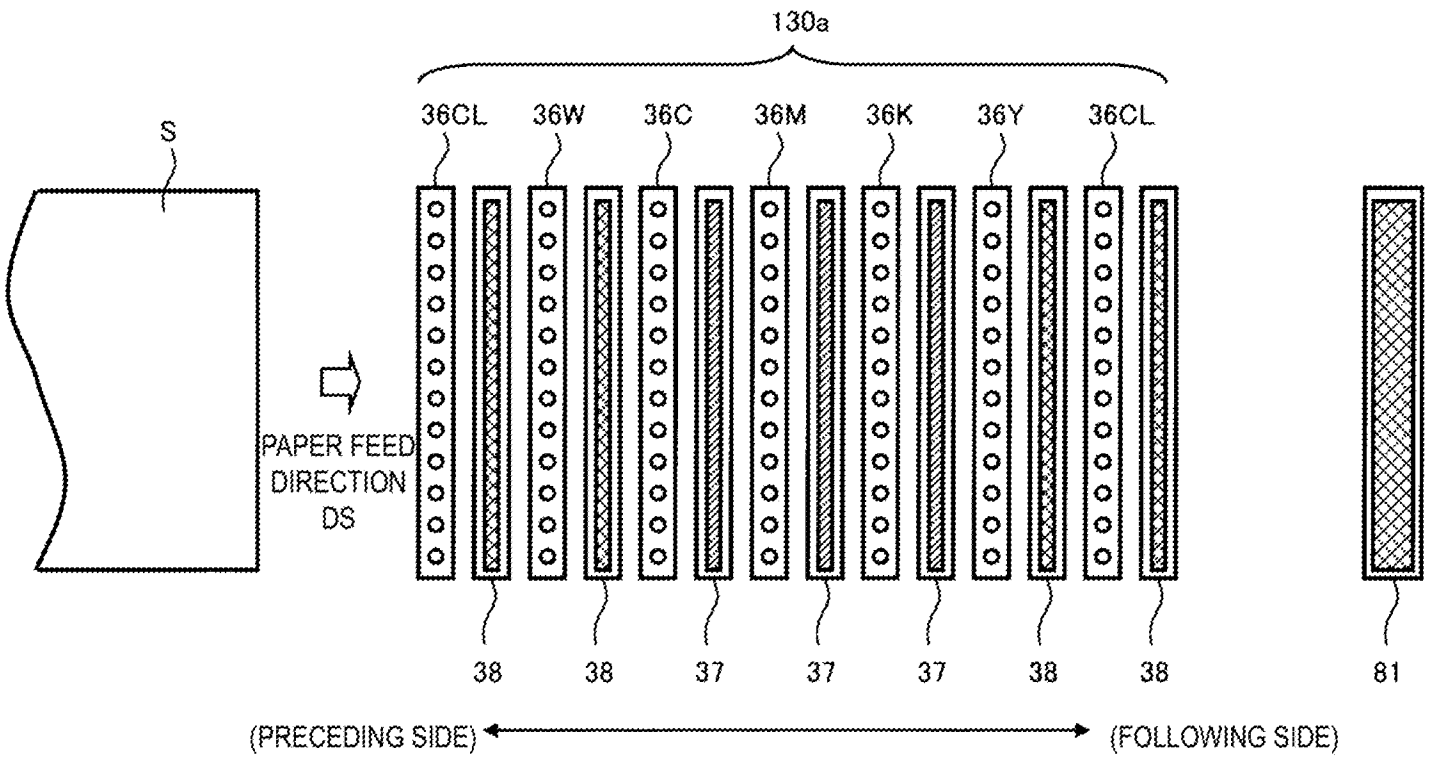
FIG. 9 is an explanatory view illustrating an arrangement of nozzle rows and light irradiators of a printing head according to another exemplary embodiment.

FIG. 9 is an explanatory view illustrating an arrangement of nozzle rows and light irradiators of a printing head 130*a* in still another exemplary embodiment. The printing head 130*a* includes a configuration in which the nozzle row 36CL for clear ink CL and the light irradiator 38 are additionally provided at the most upstream side of the printing head 130 of First Exemplary Embodiment illustrated in FIG. 2, and the other configurations are the same as in First Exemplary Embodiment. There is an advantage in that the use of the printing head 130*a* illustrated in FIG. 9 causes dot omission of other inks to be compensated using the clear ink CL.

C. Other Aspects

The present invention is not limited to the exemplary embodiments described above, and can be realized in various aspects without departing from the gist of the invention. For example, the invention can also be realized according to the following aspects. For example, technical features in the above-described exemplary embodiments corresponding to the technical features in the aspects described below can appropriately be replaced or combined to address some or all of the above-described issues or to achieve some or all of the above-described effects. Additionally, when the technical features are not described herein as essential technical features, such technical features may be deleted appropriately.

(1) The first aspect of the present invention provides a printing method for forming ink dots on a printing medium using a plurality of nozzle rows that discharge a plurality of types of photocurable inks. The printing method includes detecting a defective nozzle that has an ink discharge fault, and compensating for dot omission by causing, preceding the defective nozzle, a preceding nozzle that discharges an inducing ink different from a compensation target ink, which the defective nozzle should have discharged, to discharge the inducing ink to a position on the printing medium where a dot omission is caused by the defective nozzle.

According to this printing method an inducing ink to be discharged to a position where the dot omission occurs using the preceding nozzle that precedes the defective nozzle, even if dot omission occurs when printing is performed using photocurable ink, the dot formed using the preceding nozzle induces the ink of the dots around the dot omission, thus compensating for the dot omission.

(2) In the above printing method, the compensation target ink may include a chromatic color ink or black ink, and the inducing ink may be a white ink or clear ink.

According to this printing method, a preceding nozzle is used to form dots using a white ink or clear ink at a position where dot omission occurs, thus compensating for the dot omission with almost no change in the hue of the printed material.

(3) In the above printing method, the compensation target ink may include a chromatic color ink or black ink, and when a pixel existing at a position where a predefined neighboring condition is satisfied with respect to a position where the dot omission occurs is defined as a neighboring pixel and in case when an amount of the compensation target ink to be discharged to the neighboring pixel is not less than a predefined threshold value, a chromatic color ink of a hue different from the compensation target ink may be selectable as the inducing ink.

According to the printing method, when the amount of the compensation target ink neighboring a position where dot omission occurs is large, the hue of the printed material does not change in an excessive manner even if a chromatic color ink having a hue different from the compensation target ink is selected, thus more flexibly compensating for dot omission without significantly changing the hue of the printed material.

(4) In the above printing method, an ink with the largest remaining amount of ink, among the chromatic color inks to be discharged, preceding the defective nozzle, may be selected as the inducing ink.

According to this printing method, dot omission are compensated using a chromatic color ink with a large remaining amount of ink, thus compensating for dot omission while enhancing ink utilization efficiency.

(5) In the above printing method, when a pixel existing at a position where a predefined neighboring condition is satisfied with respect to a position where dot omission will occur is defined as a neighboring pixel, an amount of the inducing ink to be discharged to the position where the dot omission occurs may be increased as the amount of the compensation target ink to be discharged to the neighboring pixel becomes larger.

According to the printing method, in a case when the amount of the compensation target ink neighboring a position where the dot omission occurs is large, the hue in a region of the neighboring pixel does not change in an excessive manner even if the ink is induced to the inducing ink, thus compensating for the dot omission without significantly changing the hue of the printed material.

(6) The above printing method may further include adjusting a compensation effect of the inducing ink by adjusting an intensity of light irradiated on the inducing ink existing on the printing medium, after the inducing ink is discharged using the preceding nozzle and before the compensation target ink is discharged using a nozzle row including the defective nozzle.

According to this printing method, the compensation effect of the inducing ink is adjusted by adjusting the light intensity, thus a desirable compensation effect can be obtained.

(7) In the above printing method, the adjusting may include, when a pixel existing at a position where a predefined neighboring condition is satisfied with respect to a position where dot omission occurs is defined as a neighboring pixel, (i) executing, when printing is performed using a first-type printing medium, adjustment to increase an intensity of light to be irradiated to the inducing ink as the amount of the compensation target ink to be discharged to the neighboring pixel becomes larger, and (ii) executing, when printing is performed using a second-type printing medium having a surface property different from that of the first-type printing medium, adjustment to decrease an intensity of light to be irradiated on the inducing ink as the amount of the compensation target ink to be discharged to the neighboring pixel becomes larger.

According to this printing method, an adjustment direction of an intensity of light irradiated on the inducing ink is set reversed in accordance with the type of the printing medium, thus a suitable effect of compensating for dot omission in accordance with the type of printing medium can be obtained.

(8) The second aspect of the present invention provides a printing apparatus configured to form ink dots on a printing medium. The printing apparatus includes a printing head including a plurality of nozzle rows that discharge a plurality of types of photocurable inks, a light irradiator configured to irradiate photocuring light on the printing medium, the ink being discharged from each of the plurality of nozzle rows, a controller configured to execute discharge control to cause the plurality of nozzle rows to discharge inks, and a defective nozzle detector configured to detect a defective nozzle that has an ink discharge fault. The controller is configured to compensate for dot omission by causing, preceding the defective nozzle, a preceding nozzle that discharges an inducing ink different from a compensation target ink, which the defective nozzle should have discharged, to discharge the inducing ink to a position on the printing medium where dot omission is caused by the defective nozzle.

According to this printing apparatus, an inducing ink is discharged to a position where the dot omission will occur using the preceding nozzle that precedes the defective nozzle. Even if the dot omission portion occurs during printing being performed using photocurable ink, the ink of the dots around the dot omission portion can be induced by the dot formed using the preceding nozzle, thus compensating for the dot omission.

This application claims priority under 35 U.S.C. § 119 to Japanese Patent Application No. 2018-040379, filed Mar. 7, 2018. The entire disclosure of Japanese Patent Application No. 2018-040379 is hereby incorporated herein by reference.

What is claimed is:

1. A printing method for forming ink dots on a printing medium by using a plurality of nozzle rows that discharge a plurality of types of photocurable inks, the method comprising:

detecting a defective nozzle that has an ink discharge fault; and compensating for dot omission by causing, preceding the defective nozzle, a preceding nozzle that discharges an inducing ink different from a compensation target ink, which the defective nozzle should have discharged, to discharge the inducing ink to a position on the printing medium where the dot omission is caused by the defective nozzle, wherein the compensation target ink includes a chromatic color ink or black ink, and wherein when a pixel existing at a position where a predefined neighboring condition is satisfied with respect to a position where dot omission occurs is defined as a neighboring pixel and when an amount of ink of the compensation target ink to be discharged to the neighboring pixel is not less than a predefined threshold value, a chromatic color ink of a hue different from the compensation target ink is selectable as the inducing ink.

2. The printing method according to claim 1, wherein the inducing ink includes a white ink or clear ink.

3. The printing method according to claim 1, wherein an ink with a largest remaining amount of ink, among chromatic color inks to be discharged preceding the defective nozzle, is selected as the inducing ink.

4. A printing method according for forming ink dots on a printing medium by using a plurality of nozzle rows that discharge a plurality of types of photocurable inks, the method comprising:

detecting a defective nozzle that has an ink discharge fault; and compensating for dot omission by causing, preceding the defective nozzle, a preceding nozzle that discharges an inducing ink different from a compensation target ink, which the defective nozzle should have discharged, to discharge the inducing ink to a position on the printing medium where the dot omission is caused by the defective nozzle, wherein when a pixel existing at a position where a predefined neighboring condition is satisfied with respect to a position where dot omission occurs is defined as a neighboring pixel, an amount of inducing ink to be discharged to the position where the dot omission occurs is increased as an amount of the compensation target ink to be discharged to the neighboring pixel becomes larger.

5. A printing method for forming ink dots on a printing medium by using a plurality of nozzle rows that discharge a plurality of types of photocurable inks, the method comprising:

detecting a defective nozzle that has an ink discharge fault;

compensating for dot omission by causing, preceding the defective nozzle, a preceding nozzle that discharges an inducing ink different from a compensation target ink, which the defective nozzle should have discharged, to discharge the inducing ink to a position on the printing medium where the dot omission is caused by the defective nozzle; and adjusting a compensation effect of the inducing ink by adjusting an intensity of light irradiated on the inducing ink existing on the printing medium, after the inducing ink is discharged using the preceding nozzle and before the compensation target ink is discharged using a nozzle row including the defective nozzle.

6. The printing method according to claim 5, wherein the adjusting includes, when a pixel existing at a position where a predefined neighboring condition is satisfied with respect to a position where dot omission occurs is defined as a neighboring pixel:

(i) executing, when printing is performed using a first-type printing medium, adjustment to increase an intensity of light to be irradiated on the inducing ink as the amount of ink of the compensation target ink to be discharged to the neighboring pixel becomes larger; and (ii) executing, when printing is performed using a second-type printing medium having a surface property different from that of the first-type printing medium, adjustment to decrease an intensity of light to be irradiated on the inducing ink as the amount of ink of the compensation target ink to be discharged to the neighboring pixel becomes larger.

7. A printing apparatus configured to form ink dots on a printing medium, the apparatus comprising:

a printing head including a plurality of nozzle rows that discharge a plurality of types of photocurable inks;

a light irradiator configured to irradiate photocuring light on an ink on the printing medium, the ink being discharged from each of the plurality of nozzle rows;

a controller configured to execute discharge control to cause the plurality of nozzle rows to discharge inks; and a defective nozzle detector configured to detect a defective nozzle that has an ink discharge fault, wherein the controller is configured to compensate for dot omission by causing, preceding the defective nozzle, a preceding nozzle that discharges an inducing ink different from a compensation target ink, which the defective nozzle should have discharged, to discharge the inducing ink to a position on the printing medium where the dot omission is caused by the defective nozzle, the compensation target ink includes a chromatic color ink or black ink, and when a pixel existing at a position where a predefined neighboring condition is satisfied with respect to a position where dot omission occurs is defined as a neighboring pixel and when an amount of ink of the compensation target ink to be discharged to the neighboring pixel is not less than a predefined threshold value, a chromatic color ink of a hue different from the compensation target ink is selectable as the inducing ink.

8. The printing apparatus according to claim 7, wherein an ink with a largest remaining amount of ink, among chromatic color inks to be discharged preceding the defective nozzle, is selected as the inducing ink.

9. A printing apparatus configured to form ink dots on a printing medium, the apparatus comprising:

a printing head including a plurality of nozzle rows that discharge a plurality of types of photocurable inks;

a light irradiator configured to irradiate photocuring light on an ink on the printing medium, the ink being discharged from each of the plurality of nozzle rows;

a controller configured to execute discharge control to cause the plurality of nozzle rows to discharge inks; and a defective nozzle detector configured to detect a defective nozzle that has an ink discharge fault, wherein the controller is configured to compensate for dot omission by causing, preceding the defective nozzle, a preceding nozzle that discharges an inducing ink different from a compensation target ink, which the defective nozzle should have discharged, to discharge the inducing ink to a position on the printing medium where the dot omission is caused by the defective nozzle, when a pixel existing at a position where a predefined neighboring condition is satisfied with respect to a position where dot omission occurs is defined as a neighboring pixel, an amount of inducing ink to be discharged to the position where the dot omission occurs is increased as an amount of the compensation target ink to be discharged to the neighboring pixel becomes larger.

* * * * *